United States Patent [19]

Bildner

[11] Patent Number: 4,460,195

[45] Date of Patent: Jul. 17, 1984

[54] AUTOMATIC CLAMPING AND RELEASE MECHANISM

[76] Inventor: Carolyn Bildner, Am Anger 18, 8221 Seebruck-Arlaching, Fed. Rep. of Germany

[21] Appl. No.: 224,136

[22] Filed: Jan. 12, 1981

[30] Foreign Application Priority Data

Jan. 23, 1980 [DE] Fed. Rep. of Germany ..... 3002236
Aug. 18, 1980 [DE] Fed. Rep. of Germany ..... 3031162

[51] Int. Cl.[3] ..... A63C 9/08
[52] U.S. Cl. ..... 280/612
[58] Field of Search ..... 280/611, 612, 633, 634

[56] References Cited

U.S. PATENT DOCUMENTS 3,919,563 11/1975 Lautier et al. ..... 280/612 X
3,940,156 2/1976 Marker ..... 280/611
4,135,733 1/1979 Salomon ..... 280/612
4,156,534 5/1979 Salomon ..... 280/612
4,159,124 6/1979 Salomon ..... 280/612
4,160,555 7/1979 Salomon ..... 280/612
4,280,714 7/1981 Salomon ..... 280/611

FOREIGN PATENT DOCUMENTS 0033131 8/1981 European Pat. Off. ..... 280/612

*Primary Examiner*—Joseph F. Peters, Jr.
*Assistant Examiner*—Mitchell J. Hill
*Attorney, Agent, or Firm*—Fleit, Jacobson, Cohn & Price

[57] ABSTRACT

A clamping and releasing mechanism is disclosed. In the exemplary embodiment the mechanism comprises a housing accommodating a telescopic piston-pin, the rearward end of which is mechanically locked. Pressure sensors located at the forward portion of the housing indicate the actual pressure applied to the piston pin. In the event a predetermined pressure is exceeded, a circuit produces an electric signal which actuates the mechanical lock to release the object being clamped.

13 Claims, 13 Drawing Figures

AUTOMATIC CLAMPING AND RELEASE MECHANISM

This invention concerns a means for clamping an object at a predetermined clamping pressure, which automatically releases the object when the clamping pressure is exceeded by a predetermined value.

In the case of devices for clamping objects, it is desirable that a predetermined clamping pressure for holding the object in the clamping device should not be substantially exceeded, so as not to damage or destroy the clamped object. Moreover, the predetermined clamping pressure should, in the case of the described clamping device, be capable of simple adjustment and variation, and the predetermined clamping pressure is dependent on the clamped object, the material of which the latter is made and on the measures to which the clamped object is subjected. Furthermore, such a device should be easy to re-adjust with respect to the clamping pressure, if the dimensioning of the clamped object in the clamping device should happen to change for some reason or other, for instance due to the shrinkage of plastic material in the case of a drop in temperature. It should be possible to adjust quickly and simply the clamping pressure; at the same time, the clamping pressure should be cancelled to release the clamped object immediately and reliably, if the clamping pressure exceeds a defined value.

These objects arise in conjunction with lifts, ropeways or cableways, paper processing units, plastic processing units and particularly in the case of ski-bindings.

In accordance with the inventive means, the object to be clamped is clamped between two clamping bearings, which hold the object between them, either punctiform or planar. One bearing, which, by way of example, may be spring-mounted, comprises a device for setting the clamping pressure with which the object is to be clamped. This device for setting the pressure preferably also serves as an indicator for the clamping pressure actually acting on the clamped object. After setting the predetermined clamping pressure or re-adjusting the clamping pressure due to a dimensional change of the clamped object in the direction of clamping, as may be caused, for instance, by shrinkage of the length of a plastic object in the case of a drop in temperature, the mechanism, which cancels the clamping pressure when a given value is exceeded, is set at the determined value above the initial clamping pressure. The release pressure, at which the clamping pressure is to be cancelled, is measured in the spring-mounted clamping bearing by means of pressure sensors or photoelectric barriers, which are known per se, or the like; when the set limiting value of the clamping pressure is reached, these produce an electronic signal by means of which the cancellation of the clamping pressure is released, so as to release the clamped object.

In accordance with a further embodiment of the invention, one clamping bearing is embodied such that it can be moved mechanically, for example by means of a setscrew, in the direction of the movable spring-mounted clamping bearing. Thus it is achieved that in the case of a shortening of the length of the clamped object in the clamping means, the given clamping pressure is set by corresponding motion of this clamping bearing towards the opposite bearing. The triggering of the mechanism for cancelling the clamping pressure when the predetermined and set limiting value of the clamping pressure is attained proceeds in the manner described hereinbefore.

The invention will now be described in more detail with reference to FIGS. 1 to 11; in so doing, a ski-binding will be described, as a preferred exemplary embodiment of the present invention.

Figure 5:
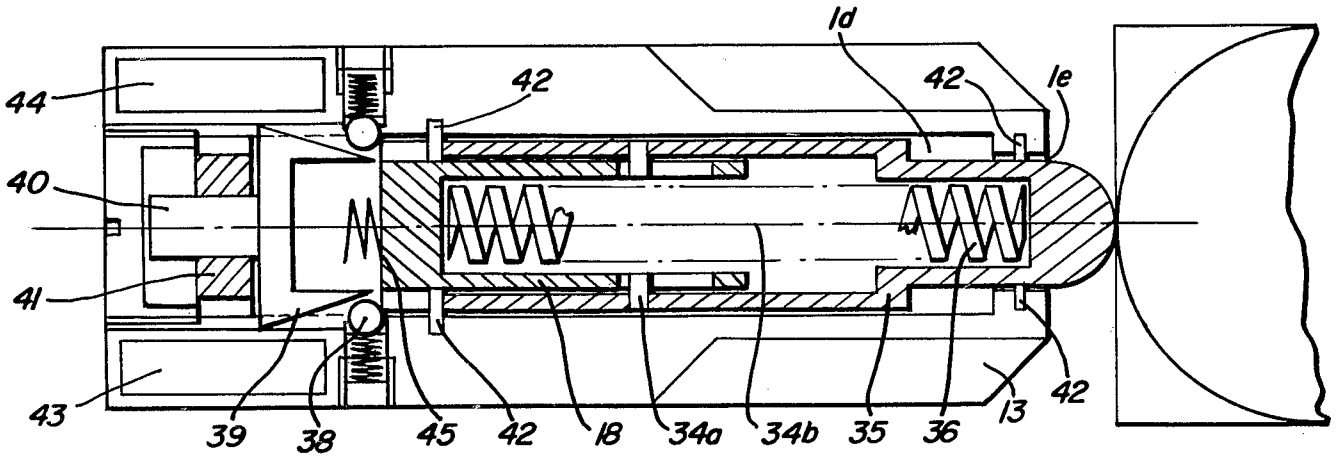
FIG. 5 is a schematic cross-section of a plan view of a component in accordance with FIGS. 3 and 4.
Figure 6:
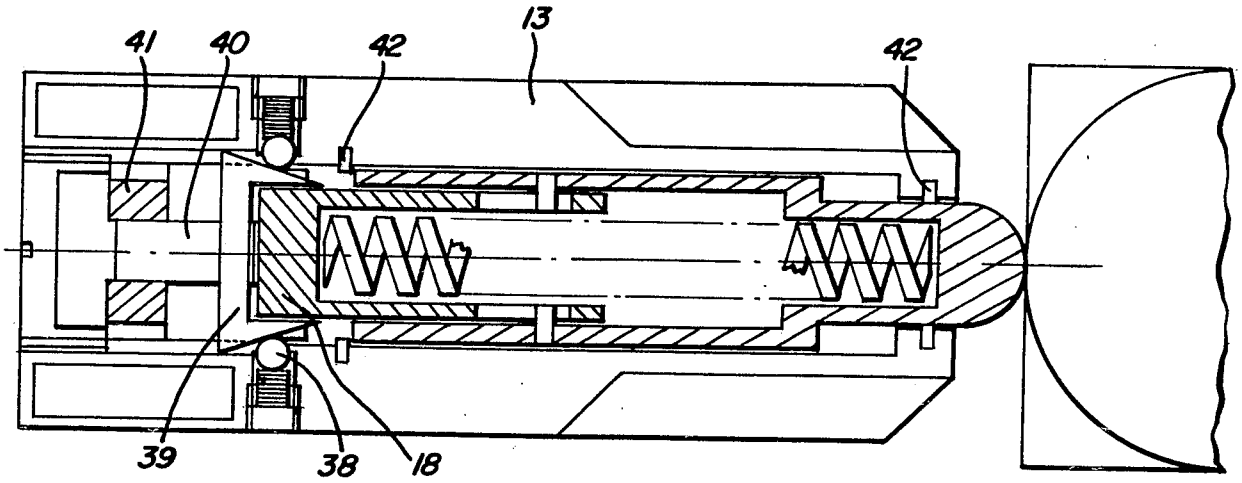
Figure 7:
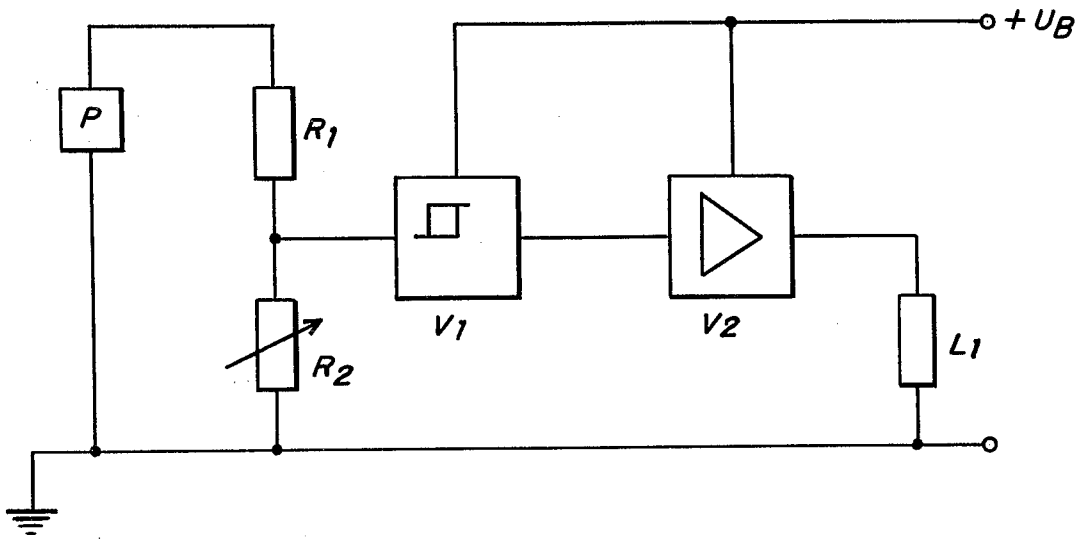
Figure 8:
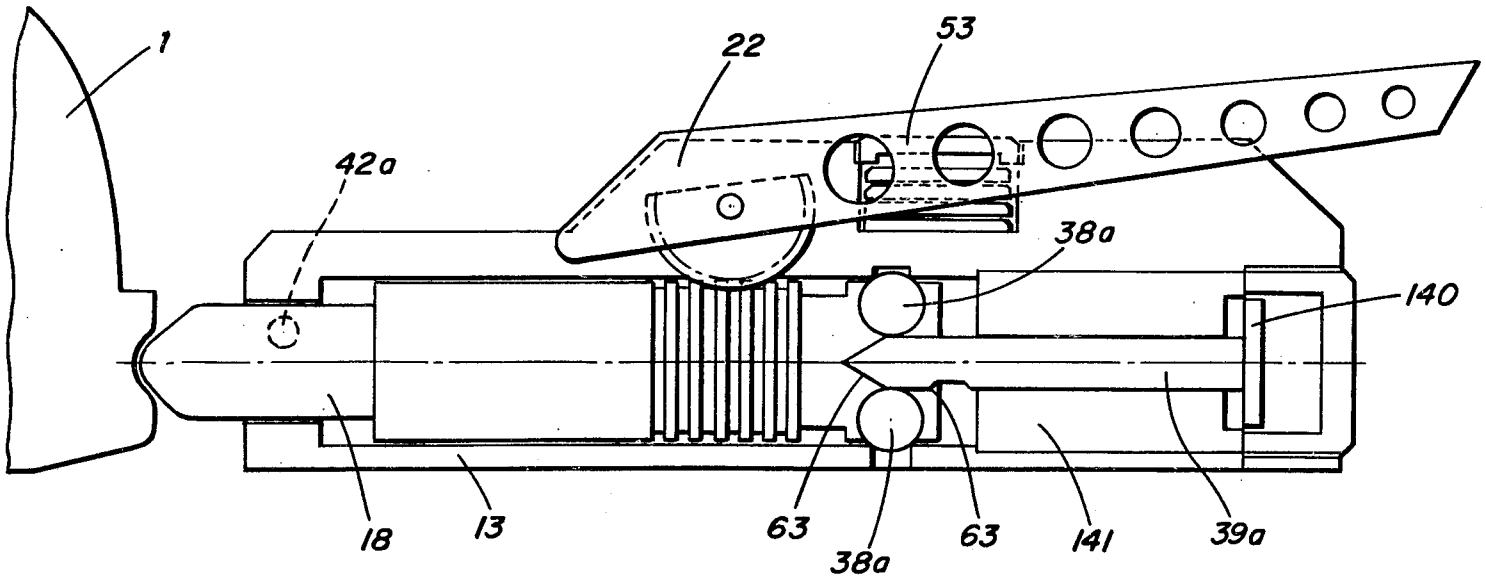
Figure 10B:
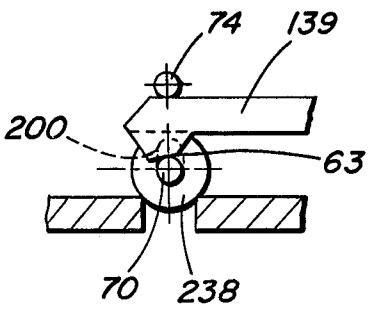
Figure 10A:
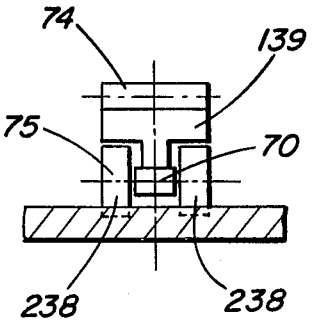
Figure 9:
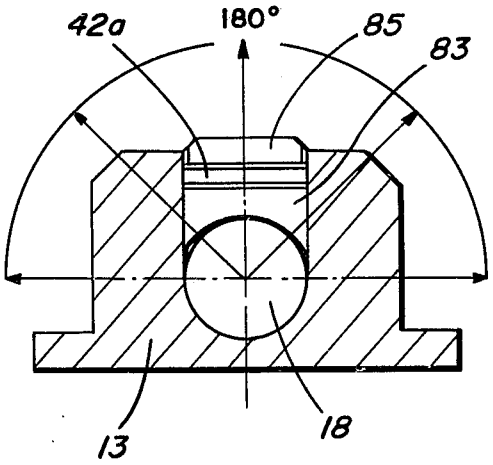
Figure 11B:
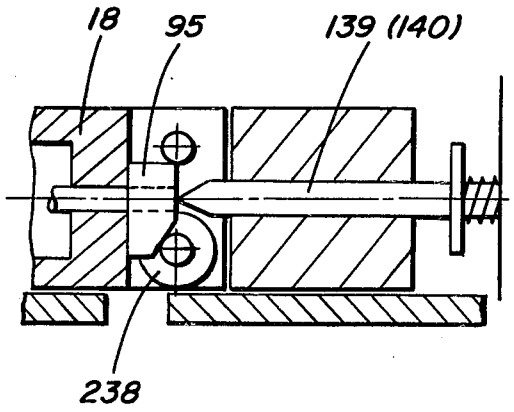
Figure 11A:
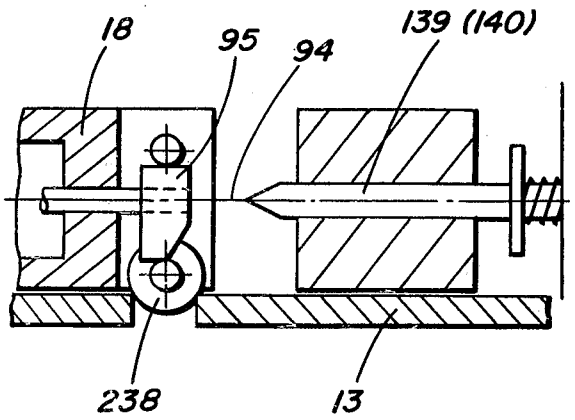

FIG. 6 corresponds to FIG. 5 in the release phase of the component;

FIG. 7 is a wiring diagram for controlling the release mechanism for releasing the clamped object;

FIG. 8 is a schematic longitudinal section through the component in accordance with FIG. 5 with a modified release mechanism;

FIG. 9 is a cross-section through a particular embodiment example of the component in accordance with FIG. 8 in the region of emergence of the spring-loaded piston pin out of the housing;

FIG 10(*a*) is a schematic partial view in cross-section, and FIG. 10(*b*) in longitudinal section of a particular embodiment example of the locking mechanism; and FIG. 11(*a*) is a schematic longitudinal section through a locking mechanism in the locked position, and FIG. 11(*b*) is a similar view illustrating the release position.

The embodiment examples of the exemplary embodiment of the present invention as a ski-binding as shown in the Figures represent only a preferred application from which, however, other applications of the type illustrated hereinbefore can be derived without any inventive step by an expert ordinarily skilled in the art.

Figure 1:
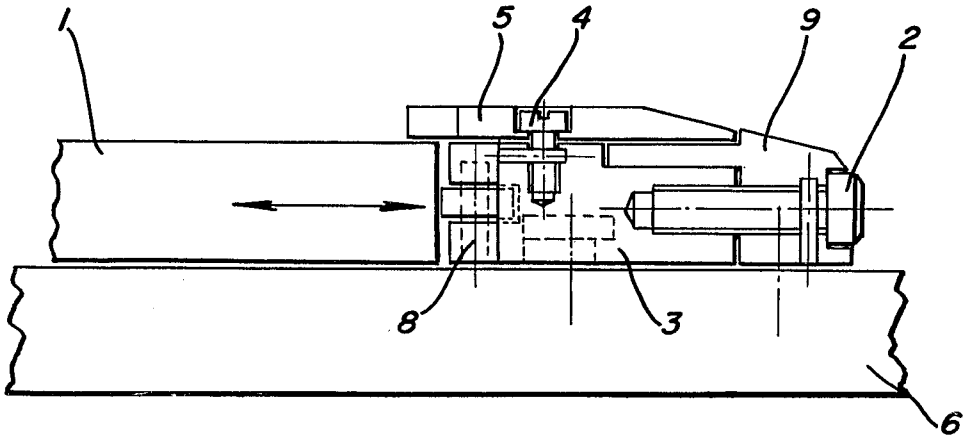
FIG. 1 is a schematic view of a cross-section of the component of one exemplary embodiment example, in which the clamping bearing, which is movable in the direction of the opposite clamping bearing, is mounted.

In FIG. 1 the object 1 to be clamped is a ski boot; the front holding means for the toe of the ski boot, which is illustrated in the drawing as being adjustable, comprises a block 9 which is rigidly mounted on the ski 6. An adjusting screw 2 for the purpose of adjusting is arranged in the block 9. The adjusting screw 2 acts on a bar 3 in the direction of the longitudinal axis of the ski, and the bar 3 is moved dependent on the rotational direction of the set-screw 2 towards or away from the automatic heel clamping and release device. In the perpendicular direction, the toe of the ski boot is held by the component 5 which is mounted by means of the screw 4 and which is vertically adjustable on the bar 3. Centering rollers, bolts and/or clasp-shaped members, which are known per se, which surround the toe of the ski boot, are provided on the sides for laterally holding the toe of the ski boot.

It is possible by means of the described structure to move the ski boot as may be necessary in the direction of the longitudinal axis of the ski by adjusting the set-screw 2 and appropriately shifting the bar 3.

Figure 2:
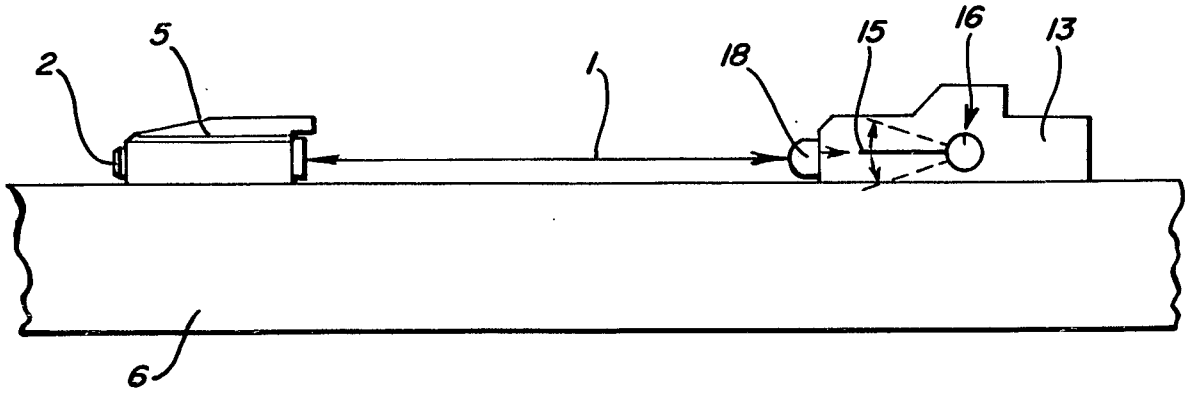
FIG. 2 is a schematic lateral view of the embodiment of FIG. 1.

FIG. 2 schematically represents the present invention in it exemplary embodiment as a ski-binding. In addition to the component in accordance with FIG. 1, the housing 13 of the automatic heel clamping and release device is arranged on the ski 6 in the rear portion of the latter.

A spring-loaded piston pin 18 in a spring-loaded piston pin housing is arranged in the housing 13. The pressure, which is exerted on the spring-loaded piston pin 18 by adjusting the adjusting screw 2 above the ski boot 1, is indicated by the position of the lever 15. This lever is arranged on an axle 16 which forms an angle of approximately 90° with the spring-loaded piston pin 18 and which is driven directly by the latter via profiles which are fitted to each other; the latter produce a horizontal swing of the lever 15, depending on the load of the spring-loaded piston pin 18, and marks are arranged for instance on the axle 16 and on the housing 13 in the region of the axle 16. The pressure acting on the spring-loaded piston pin 18 can be read off from these marks. If the clamping pressure for the ski boot, which must be determined in the usual manner, is set at +20° C., for example, this clamping pressure can be read off from the mark in the region 16. Now if the length of the ski boot 1 is reduced by a fall in temperature to −10° C., for example, the set-screw 2 is adjusted to move the ski boot 1 in the direction of the automatic heel clamping and release device 13 until the same mark adjustment is again attained, so that the predetermined clamping pressure is set.

Figure 3:
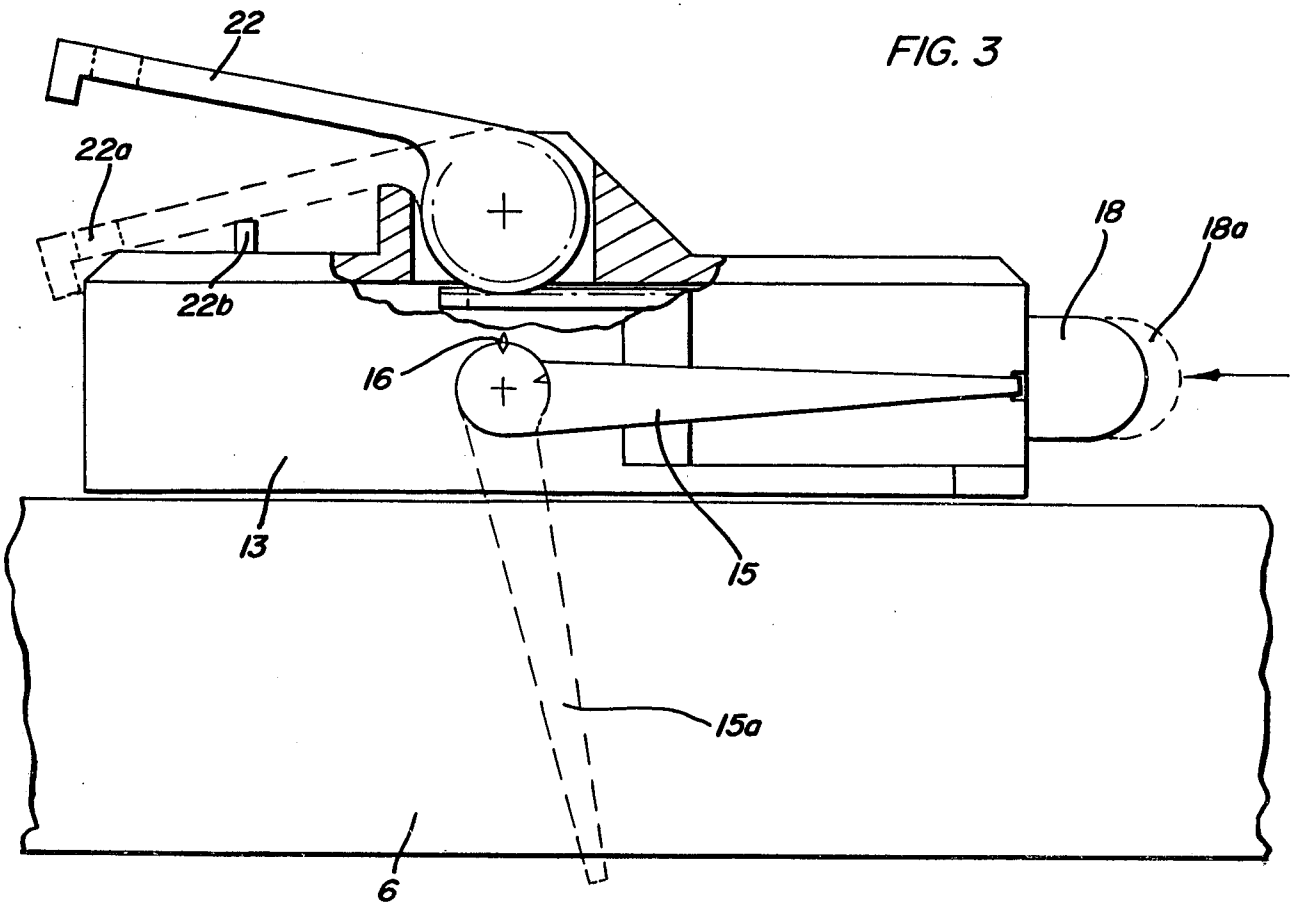
FIG. 3 is a schematic lateral view of an inventive automatic heel clamping and release device.

FIG. 3 shows a lateral view of an automatic heel clamping and release device in accordance with FIG. 2. This further includes an operating lever 22 which is known per se and which is connected via an appropriately fitted profile with the spring-loaded piston pin 18 in the upper region of the housing 13. The system is pressure-released before clamping the ski boot, i.e. the spring-loaded piston pin is at position 18*a*, the pointer lever is at position 15*a* and the operating lever is at position 22*a*. When the system is under pressure, the spring-loaded piston pin is at position 18, the pointer lever is at position 15 and the operating lever is at position 22. Otherwise, the reference numerals correspond to those according to FIG. 2.

Figure 4:
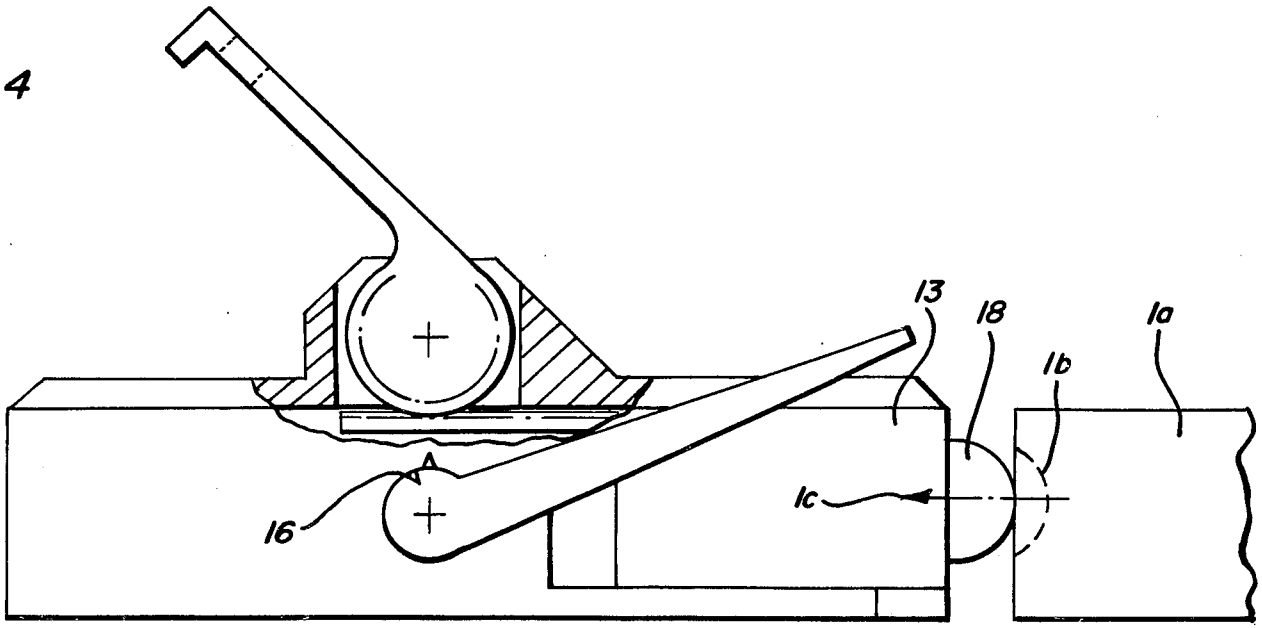
FIG. 4 is a further lateral view of a component in accordance with FIG. 3.

FIG. 4 shows the automatic heel clamping and release device in an overstrained position; by appropriately adjusting the set-screw 2 in accordance with FIG. 1, the predetermined clamping pressure can be re-set by adjusting until the marks 16 coincide. The tip 1*a* of piston pin 18 engages an object 1*b* to be clamped. The tip 1*a* of piston pin 18 is pressured in a direction indicated by arrow 1*c*. A cylindrical core 1*d*, (FIG. 5) passes through the housing 13, allowing piston pins 18 to reciprocate. The tip 1*a* passes through housing 13, through opening 1*e*. The diameter of the piston pin 18 is almost the same as the cylindrical core. Otherwise the reference numerals are the same as heretofore.

FIG. 5 is a schematic sectional representation of the inventive automatic heel clamping and release device parallel to the surface of the ski. In this case the spring-loaded piston pin 18 is embodied telescopically, in which case the two parts of the telescopic spring-loaded piston pin 18 are stayed against each other by means of a spring 36 in the interior. At least one pin 34*a* serves as a safety device against the torsion of the spring-loaded piston pin 18. In its front portion, the spring-loaded piston pin 18 comprises a stepped shoulder 35 which prevents the emergence of the spring-loaded piston pin 18 out of the housing 13 beyond a determined amount. In the region of the rear end of the spring-loaded piston pin 18, locking rollers 38 are arranged in the housing 13, and these block the yielding of the rear part of the telescopic spring-loaded piston pin 18, and the axle of these locking rollers 38 is guided in lateral, perpendicular crank slots in the rear portion of the spring-loaded piston pin 18. A bolt 39 is arranged in the end portion of the housing 13 which is movable in the direction of the longitudinal axis of the ski. This bolt comprises a cylindrical recess ln which the cylindrical rear end of the spring-loaded piston pin 18 can be held. When the bolt 39 is moved towards the tip of the ski, the blocking caused by the locking rollers 38 is released by means of the outer leading ramps on the locking bolt 39, so that the rear portion of the telescopic spring-loaded piston pin 18 can enter into the recess in the bolt 39, whereby the pressure of the spring-loaded piston pin 18 acting on the heel of the ski boot is practically cancelled. Sensors 42 for electronically recording the pressure are disposed in particular in the outlet opening of the spring-loaded piston pin 18. In this case piezo-elements are preferably used which produce a certain voltage when a determined pressure is produced, and this voltage unlocks the locking rollers 38 by means of electromagnetic movement of the bolt 39 in the direction of the tip of the ski when a determined limiting value, which corresponds to the predetermined release pressure, is reached. Photoelectric barriers or the like may also be used instead of the pressure sensors. Photoelectric barriers record, in a known manner, the shifting of the spring-loaded piston pin 18 into the housing 13 at increasing pressure and cause the unlocking of the piston pin 18, inside the housing 13, the pressure release of spring element 36 when a certain distance of the piston pin, which is proportional to the increase in pressure, is exceeded.

The unlocking mechanism comprises the bolt or bar 39 which is connected with an armature or plunger 40, the latter protruding through a coil 41. When the pressure sensors or photoelectric barriers 42 produce the unlocking signal at a predetermined release pressure acting on the spring-loaded piston pin 18, a magnetic field is produced in the magnet coil 41 by means of which the plunger 40 sets the bolt 39 in motion towards the tip of the ski, thus unlocking the piston pin 18 and releasing the pressure on the spring 36. The electromagnetic-electronic part of the device is fed by means of ordinary commercial electric batteries 43. The control functions such that the signals P, as shown in FIG. 7, from the pressure sensors or photoelectric barriers 42 read in the appropriate values into a converter. The converter can be programmed in steps in advance with respect to certain values by means of microswitches 44. If necessary, the converter may also be programmed in advance by means of a continuously adjustable resistor.

FIG. 6 shows the inventive automatic heel clamping and release device in accordance with FIG. 5 in a further state of functioning. Whereas in FIG. 5 the rear element of the telescopic spring-loaded piston pin 18 is shown in the locked position, FIG. 6 shows how this portion has entered the recess in the bar or bolt 39 provided for this purpose. Before this took place, the locking mechanism was unlocked by means of the rollers 38 by the movement of the bar or bolt 39 in the direction of the tip of the ski, and the rollers were pushed back into their spring-loaded bearings supporting the rollers by the leading profile on the bolt 39 in the region of the rollers. The forward motion of the bolt 39 described was, by way of example, triggered and caused in the manner described by means of a pressure above the set limiting value, exerted laterally on the tip of the spring-loaded piston pin 18.

In the region of the spring-loaded piston pin 18, the pressure sensors, preferably semi-conductors, measuring tapes of piezo-elements, are arranged on the piston pin or on the adjacent housing 13 and produce a certain voltage signal $P_1$ when pressure acts on the spring-loaded piston pin 18.

In accordance with FIG. 7 this voltage is divided via the bleeder chain R1 and R2. The voltage necessary for the release value is preferably picked up at R2. The same voltage acts on a threshold switch V1 which conducts an impulse to a switching amplifier V2 when a certain input voltage is attained. This switching amplifier excites a coil L1 (coil 41 in accordance with FIGS. 5 and 6) which builds up a magnetic field through which the plunger 40 with the bolt 39 (in accordance with FIGS. 5 and 6) is moved, whereby the spring-loaded piston pin 18 is unlocked. The resistor R2 can be modified by means of a potentiometer or a microswitch which place a multiple of resistors in parallel as desired. In this way, the voltage can be set in the case of a predetermined pressure which prevents mechanical unlocking when the release pressure or any higher pressure is applied for a period of less than 1/10 second. The threshold switch is a circuit which is known per se as a signal converter. The restoration of the bolt 39 (FIGS. 5 and 6) is carried out outside the electronic circuit by means of a restoring spring which is indicated in FIG. 5, for example, with reference numeral 45.

In order to disconnect partially the energy consumption, a limit switch **22*b* (FIG. 3) is provided, which is automatically switched to position 22*a* (FIG. 3) by means of the opening lever when the clamping device is in its initial position. If a pressure of approximately 50% of the release pressure acts on the spring-loaded piston pin 18 in the direction of the longitudinal axis of the ski, the opening lever 22 is raised until the spring-loaded switch 22*b*** is released and the electric circuit is closed.

The pointer or lever 15 in accordance with FIGS. 2 and 3, which serves in conjunction with the corresponding marks on the housing 13 as an indicator for the pressure acting on the spring-loaded piston pin 18, may preferably be embodied as a ski stopper. In this case, the axis, around which the component 15 rotates, is not arranged parallel to the surface of the ski, but at an angle of approximately 40° to 50°, preferably at an angle of more than 45°. In this manner, the pointer 15, which is embodied as a stopper arm, can be caused to swivel over the width of the ski when the spring 36 is under pressure, thus not protruding laterally beyond the ski. In the same way, a second pointer 15, which is embodied as a stopper arm, can be arranged on the opposite side of the housing 13.

FIG. 8 shows schematically a further unlocking mechanism of the automatic heel clamping and release device which otherwise corresponds to the automatic heel clamping and release device in accordance with FIGS. 5 and 6.

In this case, the locking of the rear portion of the telescopic spring-loaded piston pin 18 is also carried out by means of ball-shaped or roller-shaped locking elements **38*a*** which are arranged opposite each other within this region.

When locking takes place, the locking elements **38*a*, which are suspended in the piston pin 18, are partially pressed through corresponding openings in the wall of the spring-loaded piston pin 18 into corresponding seats or recesses in the adjacent housing wall, thus locking the system so that the lower portion of the spring-loaded piston pin 18 is locked with the housing 13**.

In the embodiment according to with FIG. 8 the locking elements **38*a* are held in the locking position by means of the bar or bolt 39*a* which protrudes through the rear wall of the spring-loaded piston pin 18 into the latter and between the locking elements 38*a*. In this case, the bar or bolt 39*a* is embodied as a single unit with the plunger 40 which is arranged in the coil 41 and which is set in motion in the manner described hereinbefore. The bolt 39*a*, which is embodied in this case in the form of a rod, is pointed at its front end, and the corresponding sidewalls form a profile 63 on which the locking elements 38*a*** roll on or off when locking or unlocking, respectively.

A spring element (not shown) is arranged preferably between the rear wall of the spring-loaded piston pin 18 and the coil 141. This spring element restores the rear portion of the spring-loaded piston pin 18 to its initial position for locking when the system is unlocked and when the front portion of the spring-loaded piston pin 18 is completely relieved of pressure.

The bolt **39*a* preferably extends through and beyond the rear wall of the housing 13, such that, on the one hand, the locking procedure can be carried out manually and, on the other hand, one can visually check whether the spring-loaded piston pin 18** is locked or not.

A mounting opening for the component of the automatic heel clamping and release device, arranged in the interior of the housing 13, is provided in the housing 13, and this opening can be closed by means of a screw plug 53. In this way, the inside of the automatic heel clamping and release device is easily accessible and the penetration of dirt and water into the housing is prevented at the same time. Moreover, this also makes manipulation of the adjustment of the binding by others difficult.

FIG. 9 shows schematically a cross-section through the portion of an inventive heel clamping and release device in which the front portion of the spring-loaded piston pin 18 protrudes out of the housing 13. In this embodiment example, the pressure is recorded by only one electric semi-conductor **42*a* on which the pressure, which is exerted by the ski boot 1 at the tip of the spring-loaded piston pin 18 by twisting or the like of the ski boot 1 in the binding. The twisting is transmitted via a crank 83, covering approximately 180° of the front portion of the spring-loaded piston pin 18. An adjustable screw 85 serves as a seat for the pressure recording semiconductor 42*a***.

It is preferred to arrange two cranks in a V shape in the outlet opening of the spring-loaded piston pin protruding out of the housing . This crank covers the spring-loaded piston pin over a range of approximately 90° in each case, and each of which abuts a flat-shaped pressure sensor. Finally, circular or semi-circular sensors may be used in analogous application.

FIG. 10(*a*) is a schematic cross-sectional drawing, and FIG. 10(*b*) is a schematic longitudinal sectional drawing of an inventive locking mechanism. In this case, the two locking rollers 238 and an intermediate guide roller 70 with a smaller diameter are pivoted on a mutual axle 75. The axle 75 is arranged parallel to the surface of the ski and at right angles to the longitudinal axis of the ski in the rear portion of the piston pin 18. The two ends of the axle 75 are mounted in slots 200 as shown in FIG. 10(*b*) in the sidewalls of the rear portion of the piston pin 18. The slots extend perpendicular to the surface of the ski so that in this direction the axle 75, the locking rollers 238 and the guide roller 70 are movably mounted. The front end of the bolt 39 forms a control profile which contacts guide roller 70. A bearing roller 74 serves as a seat for the bolt 39, so that the bolt 139 is mounted between the bearing roller 74 and the guide roller 70. The profile of bolt 39 operates such that upon motion of the bolt 139 in the direction of the longitudinal axis of the ski, the axle 75 with the locking rollers 238 is pressed along the surface of the guide roller 70 through the corresponding openings in the piston pin wall and housing wall, thus locking the system (FIG. 10*b*). The system is unlocked when the bolt 39 is moved in the opposite direction.

FIG. 11(*a*) and FIG. 11(*b*) are schematic drawings of a further embodiment of the present invention in the locking and release positions, respectively.

Whereas in the case of the embodiment example in accordance with FIG. 8 unlocking was carried out by means of the control profile 63 directly on the bolt 139, this control profile is mounted on a separate component 95 in accordance with this embodiment. This component 95 is movably attached in the rear portion of the spring-loaded piston pin 18 in the longitudinal direction of the automatic heel clamping and release device. This component 95, which holds the locking rollers 238 in the locking position, operates in principle in the same manner as in FIG. 8, and is driven out of the locking position into the release position towards the tip of the ski when the release signal is produced by the bolt 139 (or plunger 40), 140 which is in this case is in the shape of a pin. The free travel of the striking pin-type bolt 139 is indicated by reference numeral 94. By appropriate spring mounting of the component 95 and/or of the locking rollers 238, the latter are restored to their initial position for locking when the spring-mounted piston pin 18 is completely relieved of pressure.

The inventive means in its various embodiment examples is adjusted such that at normal temperature, for instance in a ski articles store, the binding is set in the known manner to an appropriate release value, dependent on the physical data of the skier and the ski boot material used. The electronic release is set at a somewhat lower value so that if the electronic control should happen to fail, the binding will open in the conventional manner at a somewhat higher pressure. In this way, a maximum of safety is ensured.

What is claimed is:

1. An automatic clamping and release mechanism for clamping an object to a supporting means at a predetermined clamping pressure and which automatically releases said object when a given clamping pressure is exceeded by a predetermined value comprising:

a first clamping means and an oppositely disposed second clamping means, said first clamping means being adapted to be fixed at a desired location to said supporting means relative to said second clamping means by means of a set-screw;

said second clamping means comprising a housing having a portion facing said first clamping means and having a cylindrical core therethrough, a telescopic spring-loaded piston pin movable between locking and release positions and of a diameter almost the same as said cylindrical core, said piston pin having a tip which passes through said cylindrical core to engage said object to be clamped, pressure sensor means arranged on said housing to indicate the actual pressure applied to said object to be clamped, said pressure sensor means disposed in a first portion of said housing in proximity with said tip of said piston pin which detect the pressure on said second clamping means and produces an electrical signal indicative thereof, and an electromagnetically operable mechanical locking means disposed in proximity to said piston pin in a second portion of said housing;

a circuit means, connected to said pressure sensing means to process the electrical signal and, which actuates said electromagnetically operable locking means to move said piston pin between said locking position to said release postion when said predetermined pressure acts on said pressure sensor means.

2. A mechanism according to claim 1, wherein said locking means comprises at least one locking elements which in the locked position simultaneously engages the inner wall of the housing and the rear portion of the telescopic spring-loaded piston pin and hold said portion of the telescopic spring-loaded piston pin against the wall of the housing, and said locking elements are movable perpendicular to the longitudinal axis of the supporting means.

3. A mechanism according to claim 2, wherein the locking means, when in the locked position, cooperates with a bolt which is movable in the longitudinal direction of the supporting means and which comprises a control profile, by means of which the locking means is directed either out of or into the locking position, dependent on the direction of movement of the bolt.

4. A mechanism according to claim 3, wherein the bolt cooperates with at least one of an armature and plunger and is rigidly connected thereto, and the plunger is disposed in a coil to the rear of the spring-loading piston pin in the longitudinal direction of the supporting means and is, spring mounted in the longitudinal direction of the supporting means, and said plunger moves the bolt between the locking and releasing positions when, in answer to a corresponding signal from the pressure sensors, electric current is passed through the coil which is fed by a battery disposed in the housing.

5. A mechanism according to claim 4, wherein a crank is arranged in the outlet opening of the spring-loaded piston pin, between the wall of the housing and the spring-loaded piston pin, and said crank rests on and extends over the spring-loaded piston pin covering approximately 180°, and said crank abuts a flat-shaped pressure sensor.

6. A mechanism according to claim 5 wherein at least one crank is disposed in a V arrangement in the outlet opening of the spring-loaded piston pin from the housing between the wall of the housing and the spring-loaded piston pin, and said crank rests on the spring-loaded piston pin and reaches over the latter, each covering approximately 90°, and each of said cranks abuts a flat-shaped pressure sensor.

7. A mechanism according to claim 6, wherein the circuit for releasing the mechanical unlocking system comprises a plurality of resistors each of which corresponds to a predetermined release pressure, and which can be switched on dependent on the desired release pressure.

8. A mechanism according to claim 7, wherein the circuit comprises an element which delays the recording of the pressure, and thus mechanical unlocking, when the release pressure or any higher pressure is applied for a period of less than 1/10 sec.

9. A mechanism according to claim 8, wherein the locking means comprises two locking rollers with a concentric intermediate guide roller of smaller diameter being pivoted on an axle.

10. A mechanism according to claim 9, wherein said axle is movably guided in perpendicular slots in the sidewalls of the rear portion of the telescopic spring-loaded piston pin and the control profile of the bolt cooperates only with the guide rollers.

11. A mechanism according to claim 2, wherein said locking element is ball-shaped.

12. A mechanism according to claim 2, wherein said locking element is roller-shaped.

13. A mechanism according to claim 2, wherein said locking element is bar-shaped.

* * * * *